US010711471B2

(12) United States Patent
Faresin

(10) Patent No.: US 10,711,471 B2
(45) Date of Patent: Jul. 14, 2020

(54) SUPPORT DEVICE FOR SUPPORTING BEAMS OF FORMWORK FOR FLOOR SLABS

(71) Applicant: FARESIN FORMWORK S.P.A., Breganze (IT)

(72) Inventor: Guido Faresin, Bassano del Grappa (IT)

(73) Assignee: FARESIN FORMWORK S.P.A., Breganze (IT)

( * ) Notice: Subject to any disclaimer, the term of this patent is extended or adjusted under 35 U.S.C. 154(b) by 0 days.

(21) Appl. No.: 16/122,994

(22) Filed: Sep. 6, 2018

(65) Prior Publication Data

US 2019/0071885 A1 Mar. 7, 2019

(30) Foreign Application Priority Data

Sep. 6, 2017 (IT) ..... 102017000099585

(51) Int. Cl.
*E04G 11/48* (2006.01)
*E04G 11/20* (2006.01)
(Continued)

(52) U.S. Cl.
CPC ..... *E04G 11/483* (2013.01); *E04G 11/486* (2013.01); *E04G 11/50* (2013.01); *E04G 2025/006* (2013.01)

(58) Field of Classification Search
CPC ..... E04G 11/36; E04G 11/38; E04G 11/483; E04G 11/50; E04G 2025/006; E04G 11/486
(Continued)

(56) References Cited

U.S. PATENT DOCUMENTS 1,907,877 A * 5/1933 Roos ..... E04G 11/486 249/193
3,614,048 A * 10/1971 Young ..... B28B 7/0032 249/18
(Continued)

FOREIGN PATENT DOCUMENTS

DE 3147081 A1 * 12/1982 ..... E04G 11/486
DE 4237514 A1 5/1994
(Continued)

OTHER PUBLICATIONS

Translation of DE 3147081 A1.*
Italian Search Report dated Feb. 21, 2018 issued in IT 201700099585, with partial translation.

*Primary Examiner* — Michael Safavi
(74) *Attorney, Agent, or Firm* — Scully, Scott, Murphy & Presser, P.C.

(57) ABSTRACT

A support device for supporting beams of formwork for floor slabs, which comprises an upright, the end of which can be fixed to a supporting prop that rests on the ground; a supporting head for at least one supporting beam of floor slab formwork, which is arranged coupled slideably along the upright, and elements of reversibly locking the supporting head on a preset position defined along the upright, the supporting head in turn comprises:

two plates, at least two recesses, for guiding insertion and for containment for a resting portion of the corresponding supporting beam, each one of which is provided on a respective plate, each recess having a substantially flat bottom with a breadth such as to define a variable resting point for the supporting beam along the bottom as a function of the inclination of the supporting beam.

4 Claims, 3 Drawing Sheets

(51) Int. Cl.
*E04G 11/50* (2006.01)
*E04G 25/00* (2006.01)

(58) Field of Classification Search
USPC ..... 248/357, 354.5, 354.6
See application file for complete search history.

(56) References Cited

U.S. PATENT DOCUMENTS 5,614,122 A * 3/1997 Schworer ..... E04G 11/483 249/18
5,651,914 A * 7/1997 Schworer ..... E04G 11/48 249/210
6,109,191 A * 8/2000 Schworer ..... E04G 11/483 108/115
6,871,454 B2 * 3/2005 Coday, Sr. ..... E04G 11/38 52/126.6
7,571,888 B2 * 8/2009 Arozena Bergaretxe ..... E04G 11/38 108/156
7,581,709 B2 * 9/2009 Gillespie ..... E04G 11/38 249/19
7,640,871 B2 * 1/2010 Arozena Bergaretxe ..... E04G 11/38 108/150
8,262,056 B2 * 9/2012 Schwoerer ..... E04G 11/483 248/357
8,313,079 B2 * 11/2012 Schwoerer ..... E04G 11/483 249/18
9,540,830 B2 * 1/2017 Rosati ..... E04G 17/001
10,053,875 B1 * 8/2018 Baron ..... E04G 11/50
10,119,282 B2 * 11/2018 Rosati ..... E04G 11/483
2003/0012607 A1 * 1/2003 Coday ..... E04G 11/38 405/272
2004/0075042 A1 * 4/2004 Arozena Bergaretxe ..... E04G 11/38 249/210
2009/0250589 A1 * 10/2009 Schworer ..... E04G 11/483 249/192
2009/0294627 A1 * 12/2009 Schwoerer ..... E04G 11/483 249/18
2012/0042600 A1 * 2/2012 Bacon ..... E04G 11/483 52/632
2014/0263941 A1 * 9/2014 Zhang ..... E04G 11/38 249/18

FOREIGN PATENT DOCUMENTS

DE 102015223772 A1 6/2017
EP 1251222 A2 * 10/2002 ..... E04G 11/38
EP 2372044 A1 * 10/2011 ..... E04G 11/483
FR 2414599 A1 8/1979
WO WO 2006/100694 A1 9/2006

* cited by examiner

SUPPORT DEVICE FOR SUPPORTING BEAMS OF FORMWORK FOR FLOOR SLABS

The present invention relates to a support device for supporting beams of formwork for floor slabs.

In the construction of floor slabs the use is known of support devices of the type with a drop head for formwork supporting beams. Devices of this kind comprise a supporting upright and a supporting head for at least one supporting beam of a panel of formwork, coupled along the upright.

According to some conventional versions of such devices, such as the one described in Italian utility model patent no. 262876, the supporting head comprises two plates that are arranged mirror-symmetrically and laterally adjacent to mutually opposite sides of the upright, in order to delimit a region for accommodating the ends of supporting beams. Each plate has two pairs of recesses, on opposite sides, each one for inserting an end portion of a supporting beam.

Such support devices are not devoid of drawbacks.

A first drawback arises when it is necessary to build mutually inclined formwork panels. The recesses in which the ends of the beams are accommodated do not allow the installation workers to modulate the inclination at the time of mounting the formwork structure, because their contours, dimensions, and shape structure are not adapted to this purpose.

Another drawback arises in particular when the inclination of two contiguous beams resting on a same supporting head is such as to create a dip at that supporting head. In such cases the encumbrances of the elements prevent the mounting.

The aim of the present invention is to provide a support device to improve the known art in one or more of the above mentioned aspects.

Within this aim, an object of the invention is to provide a support device in order to facilitate the construction of formworks for floor slabs which are inclined with respect to the ground they rest on, while at the same time ensuring the stability of the system.

Another object of the invention is to fix the supporting head to the prop without using screws or bolts, therefore in a faster and more practical manner than what is possible with conventional devices.

Another object of the present invention is to provide a device that allows greater versatility as a function of the inclination required, while at the same time adapting to conventional formwork structures.

Furthermore, another object of the present invention is to overcome the drawbacks of the known art in a different manner to any existing solutions.

A still further object of the invention is to provide a device that is highly reliable, easy to implement and low cost.

This aim and these and other objects which will become better apparent hereinafter are achieved by a support device for supporting beams of formwork for floor slabs, according to claim 1, optionally provided with one or more of the characteristics of the dependent claims.

Further characteristics and advantages of the invention will become better apparent from the description of a preferred, but not exclusive, embodiment of the support device according to the invention, which is illustrated by way of non-limiting example in the accompanying drawings wherein.

Figure 2:
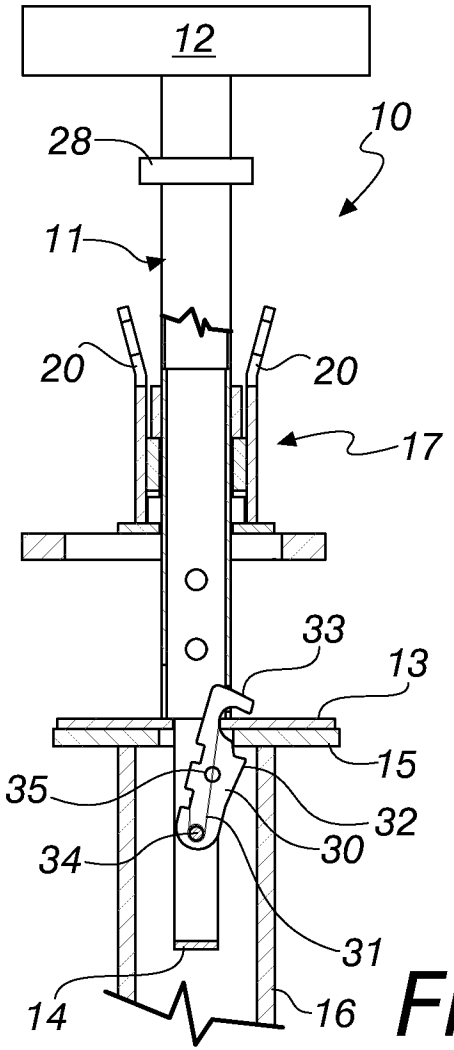
FIG. 2 is a cross-sectional side view of the device according to the invention associated with a prop.

With reference to the figures, the device according to the invention, generally designated by the reference numeral 10, comprises an upright 11, tubular and with a square cross-section, which has a T-shaped portion 12 at its end.

At the lower end of the upright 11 is a flat plate 13 downward from which, substantially aligned with the upright 11, a shank 14 extends which is to be inserted into a corresponding supporting prop 16 that rests on the ground, is tubular, and is provided with an upper plate 15 (perforated for the passage of the shank) to which to lock the aforementioned plate 13 by way of bolts.

The device 10 also comprises a supporting head 17 for at least one supporting beam 18 of floor slab formwork, which is arranged coupled slideably along the upright 11, and (conventional) means 19 of reversibly locking the supporting head 17 on a preset position defined along the upright 11.

Figure 3:
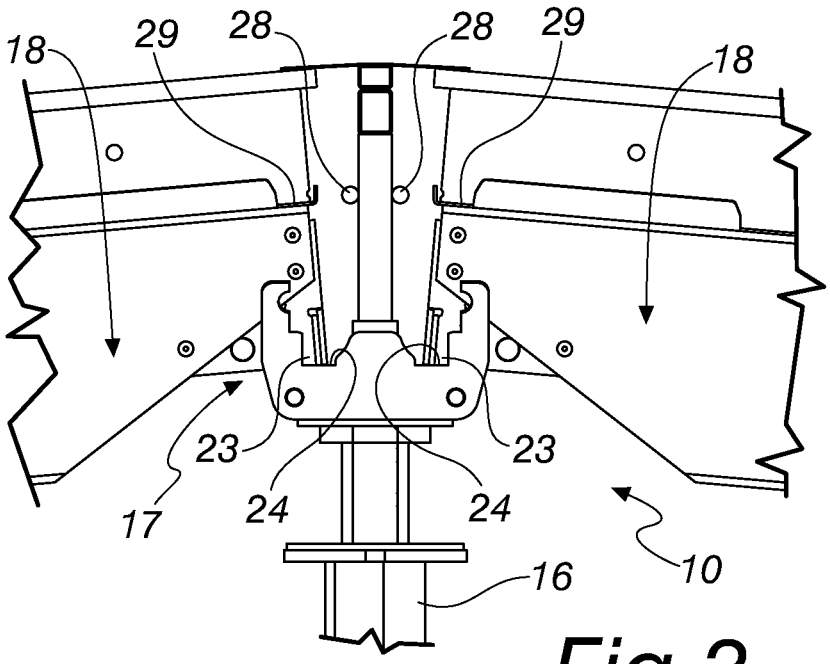
FIG. 3 is a side view of a device according to the invention associated with two supporting beams and inclined floor slab formwork panels.
Figure 4:
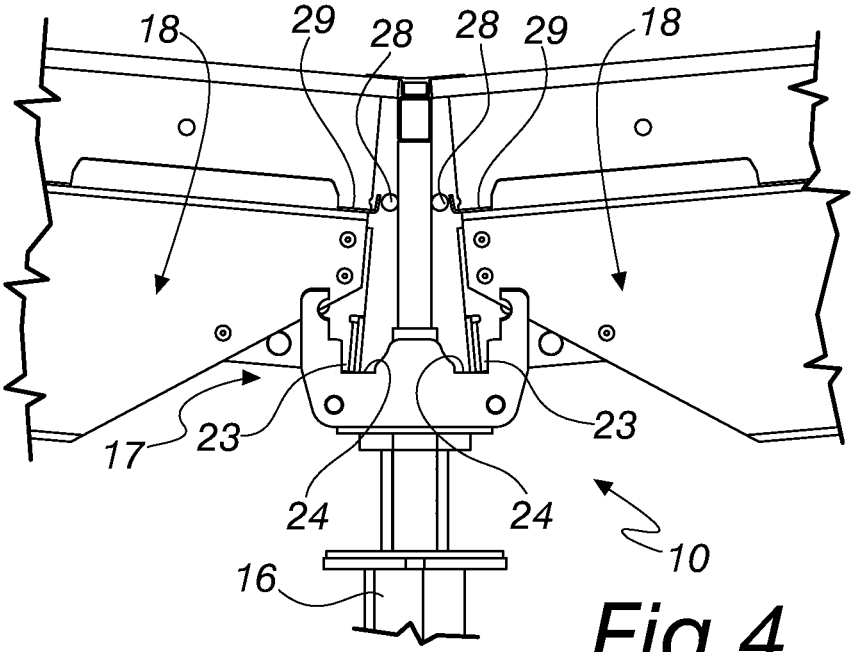
FIG. 4 is a side view of a device according to the invention associated with two formwork supporting beams and panels for floor slabs that are inclined at different angles from what is shown in FIG. 3.
Figure 5:
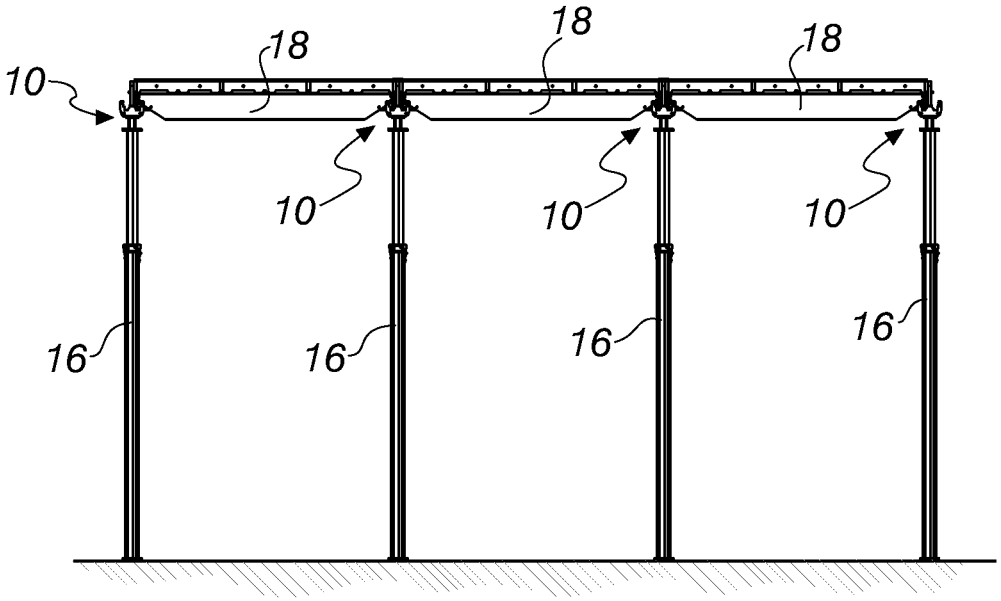
FIG. 5 is a side view of a formwork structure, built with the device according to the invention, for laying panels on the horizontal plane.
Figure 6:
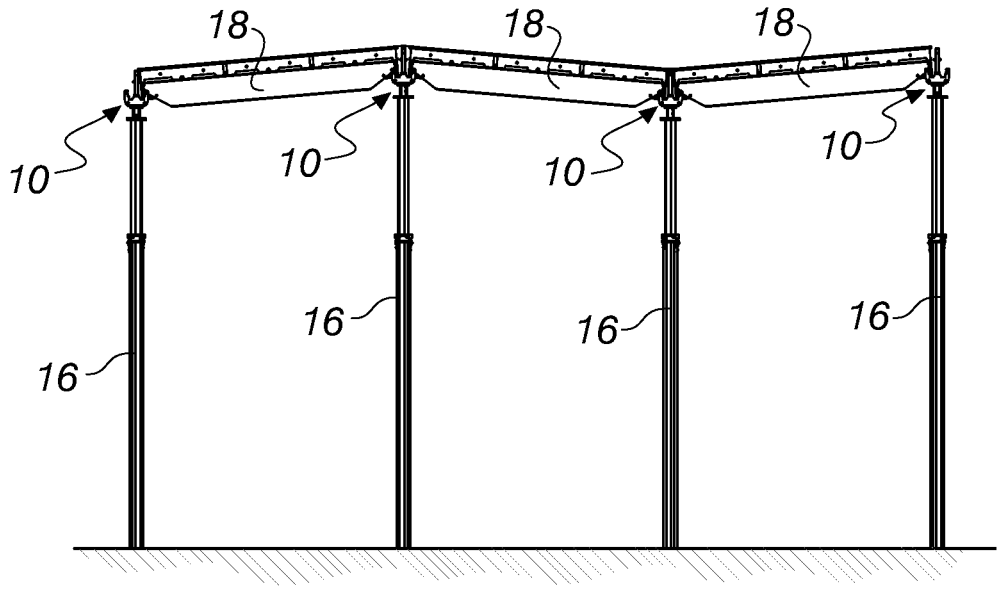
FIG. 6 is a side view of a formwork structure, built with the device according to the invention, for laying panels on inclined planes.

FIGS. 3 and 4 show the association of supporting beams 18 with the supporting head 17.

The supporting head 17 in turn comprises:

- two plates 20 which are arranged mirror-symmetrically, are laterally adjacent to opposite sides of the upright 11, and are suitable to laterally delimit a region 21 for accommodating the end of the supporting beam 18,
- two recesses 22, for guiding insertion and for containment for a resting portion 23 of the corresponding supporting beam 18, each one of which is provided on a respective one of the plates 20.

As can be understood from FIGS. 3 and 4, the plates 20 define two zones 21 for accommodating the ends of contiguous and aligned supporting beams 18.

The two recesses 22 of each plate 20 are used to rest the end of a respective supporting beam 18.

In particular, each one of such recesses 22 has a profile substantially shaped like a V advantageously with a substantially flat bottom 24 and with a breadth such as to define a variable resting point for the supporting beam 18 along the bottom 24 as a function of the inclination of the supporting beam 18.

The breadth of the bottom 24 is fundamental to allow the positioning and the simultaneous rotation of the resting portion 23 of the corresponding supporting beam 18 inside the recess 22 and to allow the coupling between the supporting head 17 and the supporting beams 18 by way of an adapted and necessary play between the individual parts.

Preferably, but not exclusively, the bottom 24 is delimited, on the side for association with the respective supporting beam 18, by a substantially vertical shoulder.

The resting portion 23 of each beam 18 is represented by the lower portion of a body shaped like an upside-down T which is provided at the end of that supporting beam 18.

The supporting head 17 is provided with safety abutment elements 25 for the end of the supporting beam 18 during the steps of erecting and removing that beam.

In particular, such safety abutment elements 25 take the form of hooked portions that extend, in continuation of the upper portions of the recesses 22, outward and upward from the plates 20.

The concavity of such hooked portions faces substantially toward the upright 11.

The upside-down T-shaped body, which defines the resting portion 23 of the end of the beam 18, engages with the hooked portions.

The supporting head 17 is furthermore provided with a cross-member 26, for connecting the two plates 20 (it takes the form of a cylindrical pin welded end-on to the two plates 20), which is adapted for temporarily resting a lower portion of the supporting beam 18 during the steps of its erection and removal.

The upright 11 has, at an upper portion 27 thereof with respect to the two plates 20 and on mutually opposite faces (the ones that face toward the sides associated with the beams), two cylindrical elements 28, one for each side, which are transverse to the direction of extension of the upright 11.

The upright 11 is further provided with a reduction in the cross-section at its upper portion 27, in order to not interfere with the panels of formwork when the beams are inclined.

As can be seen in FIGS. 3 and 4, the supporting beams 18 are provided with folded metal sheets 29 at their ends. When the supporting beam 18 is inclined to define, with respect to a reference plane like that of the plate 13, an angle smaller than the straight angle at the resting region of the beam (as shown in FIG. 4), the cylindrical elements 28, because of their particular shape in cross-section, do not interfere with the folded metal sheets 29 and as a consequence they block the positioning of the panels.

Figure 1:
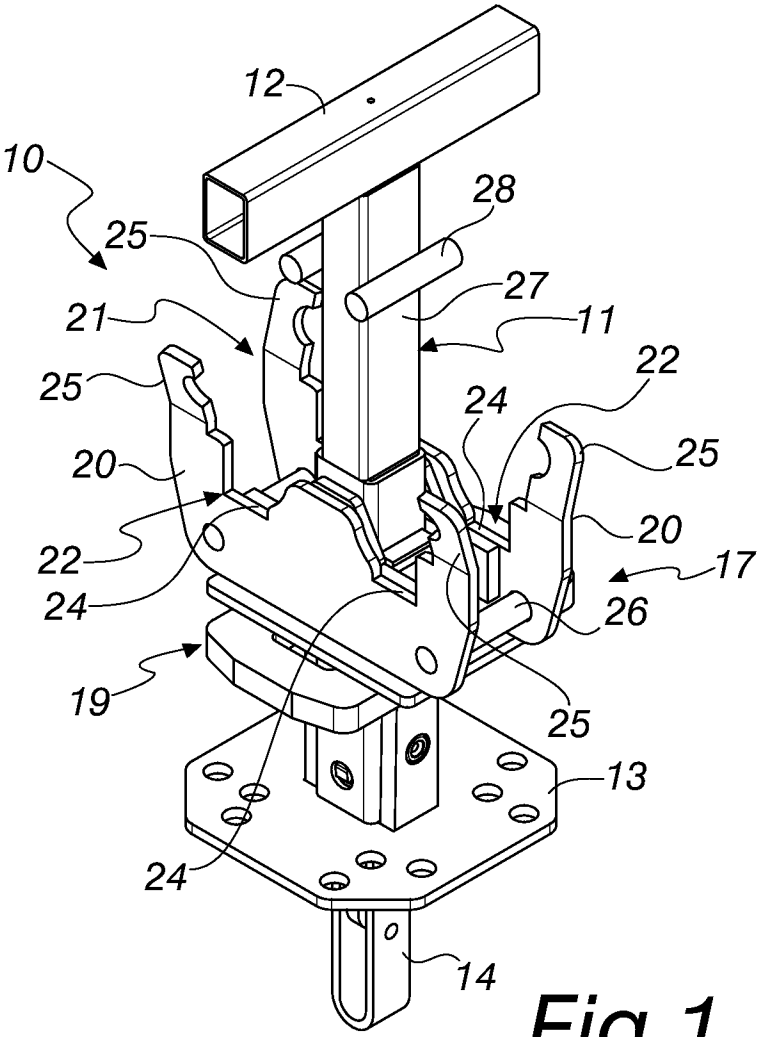
FIG. 1 is a perspective view of a device according to the invention.

As shown in FIG. 1, the lower shank 14 is open on opposite sides and with it the device 10 can be inserted from above into the corresponding supporting prop 16 that supports the upper plate 15 with an opening for the insertion of the shank 14.

As shown in FIG. 2, inside the shank 14 there is an engagement element 30 with which elastic means 31 are associated and which can rotate about an axis that is transverse to the shank 14 (by way of a rotation pin that passes through the shank in the direction of the axis) from a first configuration to a second configuration for which it is adapted to engage, by way of an extraction-preventing shoulder 32, with the upper plate 15.

The engagement element 30 has a hooked portion 33 with which it is adapted to protrude from an adapted hole provided on the upright 11, pushed so as to rotate by the elastic means 31, which consist of a torsion spring.

In the first configuration, not shown, the hooked portion 33 is pushed manually by the operator toward the inside of the upright 11, thus causing the rotation of the engagement element 30 about an axis that is transverse to the shank 14, and therefore to the upright 11.

The engagement element 30 conveniently has a hole for the insertion of a rotation pin 34, along the transverse axis.

When the upright 11 is inserted with the shank 14 into the prop 16, the operator stops pushing and the spring causes the return of the engagement element 30 to the initial position, i.e. the second configuration, in which the hooked portion 33 is protruding from the hole of the upright and is directed toward the upper face of the plate 13 and with the extraction-preventing shoulder 32 below the upper plate 15.

The coupling makes the fixing faster and more practical.

Advantageously, the engagement element 30 has another through hole 35, for an optional element for locking the hook in the position corresponding to the first configuration. In such case the device and the prop can be connected by way of screws and bolts.

The fixing of the two elements can occur by coupling and alternatively or additionally by bolting the plate 13 to the plate 15.

In practice it has been found that the invention fully achieves the intended aim and objects, with a support device that facilitates and simplifies the construction of formworks for floor slabs which are inclined with respect to the ground they rest on, while at the same time ensuring the stability of the system and enabling greater versatility as a function of the inclination required.

The invention, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102017000099585 from which this application claims priority are incorporated herein by reference.

What is claimed is:

1. A support device for supporting beams of formwork for floor slabs, which comprises an upright, the end of which can be fixed to a supporting prop that rests on the ground; a supporting head for at least one supporting beam of floor slab formwork, wherein the at least one supporting beam has a first end opposed to a second end along the length of the at least one supporting beam, which is arranged to be coupled slideably along said upright; and means for reversibly locking said supporting head on a preset position defined along said upright, said supporting head in turn comprising:

two plates which are arranged mirror-symmetrically, are laterally adjacent to opposite sides of said upright and are suitable to laterally delimit a region for accommodating the first end of said at least one supporting beam, at least two recesses, for guiding insertion and for containment for a resting portion of the at least one supporting beam, each one of which is provided on a respective one of said plates, wherein each one of said at least two recesses has a substantially flat bottom with a breadth such as to define a variable resting point for said at least one supporting beam along said bottom as a function of the inclination of said at least one supporting beam, wherein said upright comprises a central axis, wherein said bottom is delimited, on the side for association with the respective said at least one supporting beam, by a vertical shoulder that is substantially parallel with said central axis of said upright.

2. The device according to claim 1, wherein said upright has, at an upper portion thereof with respect to said two plates and on mutually opposite faces, two cylindrical elements, one for each side, which are transverse to the direction of extension of said upright.

3. The device according to claim 1, further comprising a lower shank that is open on opposite sides, inside said shank there being an engagement element with which elastic means are associated and which can rotate about an axis that is transverse to said shank from a first configuration to a second configuration for which it is adapted to engage, by way of an extraction-preventing shoulder, said upper plate.

4. The device according to claim 1, wherein said upright has a reduction in cross-section at said upper portion thereof.

* * * * *